US005320269A

United States Patent [19]

Deschenes et al.

[11] Patent Number: 5,320,269

[45] Date of Patent: Jun. 14, 1994

[54] APPARATUS FOR DISPENSING INDIVIDUAL PLASTIC FASTENERS FROM CONTINUOUSLY CONNECTED LADDER STOCK

[75] Inventors: Charles L. Deschenes, North Attleboro, Mass.; William J. Cooper, Woonsocket, R.I.; Philip G. Backholm, Northboro, Mass.; Paul A. Davignon, Uxbridge, Mass.

[73] Assignee: Avery Dennison Corp., Pasadena, Calif.

[21] Appl. No.: 970,060

[22] Filed: Nov. 2, 1992

[51] Int. Cl.[5] ..... B65C 7/00

[52] U.S. Cl. ..... 227/67; 227/76

[58] Field of Search ..... 227/26, 67, 70, 71, 227/73, 76, 99, 100, 69, 72

[56] References Cited

U.S. PATENT DOCUMENTS

| | | | |
|---|---|---|---|
| 3,103,666 | 9/1963 | Bone . | |
| 3,815,798 | 6/1974 | Lavitch et al. . | |
| 3,990,619 | 11/1976 | Russell | 227/76 X |
| 4,121,487 | 10/1978 | Bone . | |
| 4,273,279 | 6/1981 | Kunreuther . | |
| 4,456,161 | 6/1984 | Russell . | |
| 4,533,076 | 8/1985 | Bourque . | |
| 4,706,362 | 11/1987 | Strausburg | 227/76 X |
| 4,955,475 | 9/1990 | McCarthy et al. . | |
| 4,998,661 | 3/1991 | Deschenes et al. . | |
| 5,024,365 | 6/1991 | Bourque . | |

*Primary Examiner*—Rinaldi Rada
*Attorney, Agent, or Firm*—Kriegsman & Kriegsman

[57] ABSTRACT

An apparatus for dispensing an individual plastic fastener from continuously connected ladder stock including an elongated side member having a plurality of T-bars interconnected by severable connectors. In one embodiment, the apparatus includes a hollow, gun-shaped casing having a barrel portion and a handle portion. The front end of the barrel portion has an opening into which a hollow slotted needle is removably mounted. A triggering mechanism, which includes a pivotally-mounted trigger, is connected to the handle portion of the casing. A slider assembly, which is actuated by squeezing the trigger, includes a slider adapted to travel along longitudinally extending rails formed along the inside of the barrel portion of the casing. Movement of the slider is coupled to a feeding-/severing/ejecting assembly, which collectively functions to feed a T-bar disposed at one end of the elongated side member into the hollow slotted needle, to break the severable connector connecting the inserted T-bar to the remainder of the elongated side member, and to eject the inserted T-bar from the hollow, slotted needle. In a preferred embodiment, the severable connector is broken by pivoting the rear portion of the connector away from the front portion of the connector.

10 Claims, 15 Drawing Sheets

APPARATUS FOR DISPENSING INDIVIDUAL PLASTIC FASTENERS FROM CONTINUOUSLY CONNECTED LADDER STOCK

BACKGROUND OF THE INVENTION

The present invention relates to a new and improved apparatus for dispensing individual plastic fasteners from continuously connected ladder stock.

Plastic fasteners of the type having, for example, a T-bar at one end, a paddle at the other end, and a thin filament or cross-link connecting the two ends, are widely used in commerce to attach labels or other items to articles in a manner which minimizes the risk of inadvertent detachment therefrom. Typically, such plastic fasteners are manufactured in the form of fastener stock, a multi-unit assemblage of fasteners produced by molding or stamping from flexible plastic materials, such as nylon, polyethylene, and polypropylene. One type of fastener stock, referred to as continuously connected ladder stock (or, more specifically, as continuously molded ladder stock), typically comprises a pair of elongated side members interconnected by a plurality of cross links or filaments. Typically, one side member is shaped to define a plurality of co-planar T-bars which are joined together by short severable connectors, the connectors being defined by indentations or notches formed along the side member.

Additional information pertaining to fastener stock in general or to continuously connected ladder stock in particular may be obtained from the following commonly assigned U.S. patents, all of which are incorporated herein by reference: U.S. Pat. No. 4,955,475, issued Sep. 11, 1990; U.S. Pat. No. 4,456,161, issued Jun. 26, 1984; U.S. Pat. No. 4,121,487, issued Oct. 24, 1978; and U.S. Pat. No. 3,103,666, issued Sep. 17, 1963.

The dispensing of individual fasteners from fastener stock into desired articles of commerce is typically accomplished with an apparatus commonly referred to as a "tagger gun." Typically, a tagger gun includes a mechanism for cutting an individual fastener from the fastener stock and a mechanism for feeding the individual fastener through a needle at the front end of the tagger gun so that it may be inserted into the desired article of commerce.

In the commonly assigned U.S. Pat. No. 5,024,365, which issued Jun. 18, 1991 and which is herein incorporated by reference, an improved system for dispensing a fastener through a slotted hollow needle from continuously connected ladder stock is described. The system includes an actuator slide with a central channel, such actuator slide being secured to the ejector rod and fastener stock feed mechanism to actuate these functions. The system further includes a shuttle assembly which reciprocates transversely to the needle axis to cause the cutting of a fastener from the ladder stock, and transport of the severed fastener to the needle axis . The cam bar is linked to the shuttle mechanism and pivotally mounted so that the pivoting of the cam bar causes the transverse shuttle motion. The cam bar passes through the actuator slide channel, whereby sliding of the actuator slide causes pivoting of the cam bar according to the profile of the cam. The apparatus, which is trigger-operated, further includes an antiback mechanism in the form of a catch lever which engages the trigger when it has been partially depressed and prevents its release, until the trigger has been fully depressed.

In the commonly assigned U.S. Pat. No. 4,456,161, which issued Jun. 26, 1984, an apparatus for dispensing fasteners is described. The apparatus comprises a casing, a dispensing hollow slotted needle mounted on the casing, means for advancing a fastener to a position adjacent the rear of the needle bore with its end-bar transversely disposed to the longitudinal axis of the bore, means for aligning the end-bar with the needle bore, and means for dispensing the end-bar through the bore. Preferably, the apparatus comprises a feed wheel, an aligning means comprising a reciprocating cam slide which also actuates the feed wheel, a dispensing means comprising a plunger carried by a reciprocating support which also actuates the cam slide, and means for reciprocating the support.

Additional types of tagger guns are described in the commonly assigned U.S. Pat. Nos. 4,121,487 and 3,103,666, which are referred to above.

Applicants have recognized that one disadvantage with tagger guns of the type described above is that such tagger guns are typically designed so that an individual fastener is cut from the fastener stock prior to its being loaded into the needle mounted at the front end of the tagger gun. This sequence of events occasionally results in jamming of the tagger gun as the severed fastener, which may possess slight deformities as a result of the cutting step, must be transported from the cutting station to the needle and then loaded into the needle for dispensing.

Applicants have also recognized that tagger guns of the type described above occasionally experience losses in accuracy and control during the feeding, cutting, and/or ejecting steps. These losses in accuracy and control, which may result in jamming of the tagger gun, appear to be attributable to use of the cross link or "filament" portion of the fastener to position the fastener during the feeding, cutting, and/or ejecting steps.

SUMMARY OF THE INVENTION

It is an object of the present invention to provide a new and improved apparatus for dispensing individual plastic fasteners from continuously connected ladder stock.

It is another object of the present invention to provide an apparatus as described above which includes a mechanism for loading a single T-bar into a dispensing needle prior to the T-bar being separated from the remainder of the ladder stock.

It is still another object of the present invention to provide an apparatus as described above which does not employ a cutting technique, e.g. a knife, to separate individual T-bars from the ladder stock.

It is yet another object of the present invention to an apparatus as described above which does not use the filament portion of a fastener to position the fastener for feeding, separation, and/or ejection.

It is still yet another object of the present invention to provide an apparatus as described above which, in comparison to existing devices, has a minimal number of parts, is easy to assemble, may be less costly to manufacture, and may be less likely to break.

It is a further object of the present invention to provide an apparatus as described above which includes a dispensing needle which can be installed in the nose of the apparatus and removed therefrom more easily and more reliably than can typically be achieved using existing devices.

It is still a further object of the present invention to provide an apparatus as described above which includes supply means capable of holding a large quantity of fastener stock and which, therefore, does not need to be re-loaded with fastener stock as frequently as is typically the case with existing devices.

In accordance with the objects of the present invention as broadly recited above, an apparatus for dispensing an individual plastic fastener from continuously connected ladder stock including an elongated side member having a plurality of T-bars interconnected by severable connectors is provided herewith, the apparatus comprising a hollow casing, a hollow, slotted needle mounted at the front end of the hollow casing, a triggering mechanism, means coupled to said triggering mechanism for advancing the continuously connected ladder stock in such a way that the T-bar disposed at one end of the elongated side member is fed into said needle, means coupled to said triggering mechanism for severing the severable connector connecting the inserted T-bar to the remainder of the elongated side member, and means coupled to said triggering mechanism for ejecting the inserted T-bar from said hollow, slotted needle.

In a preferred embodiment of the invention, the severing means of the present apparatus does not include a cutting element, such as a knife blade or the like. Instead, the severing means preferably includes a pawl engageable with the severable connector interconnecting a first T-bar and an adjacent, second T-bar, the pawl being mounted within the hollow casing in such a way as to engage the severable connector connecting the first T-bar to the second T-bar and to pivot the front portion of the second T-bar away from the first T-bar until the severable connector breaks. This mechanism for severing the severable connector has been found to be particularly advantageous since it typically results in the severable connector being broken in a cleaner and more reproducible fashion than is typically observed when a cutting element is used to cut the severable connector.

The present invention is also directed to a method for dispensing an individual plastic fastener from continuously connected ladder stock, the ladder stock including an elongated side member having a plurality of T-bars interconnected by severable connectors, the method comprising providing a hollow slotted needle, inserting into the hollow slotted needle a single T-bar disposed at one end of the elongated side member, severing the severable connector connecting the inserted T-bar to the remainder of the elongated side member, and ejecting the inserted T-bar from said hollow, slotted needle.

Additional objects, as well as features and advantages, of the present invention will be set forth in part in the description which follows, and in part will be obvious from the description or may be learned by practice of the invention. In the description, reference is made to the accompanying drawings which forms a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In these drawings wherein like reference numerals represent like parts:

FIG. 3(*b*) is a front elevational view of the apparatus shown in FIG. 3(*a*);

FIG. 7(*c*) is a section view of the carriage shown in FIG. 8(*b*) taken along line A—A;

DETAILED DESCRIPTION OF PREFERRED EMBODIMENTS

Figure 1:
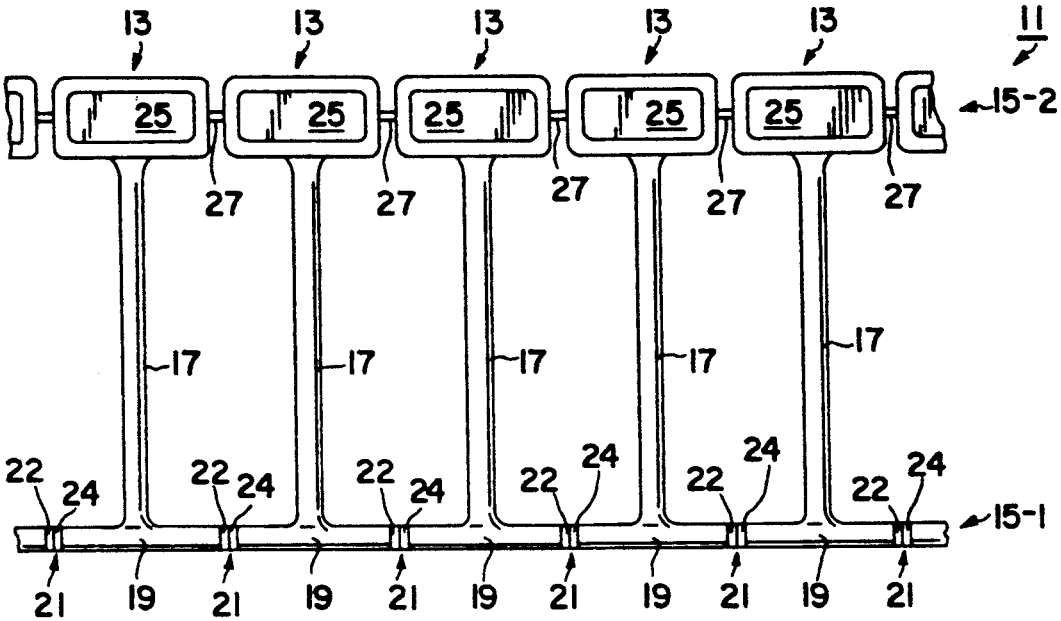
FIG. 1 is a fragmentary front elevational view of one type of continuously connected ladder stock.
Figure 2:
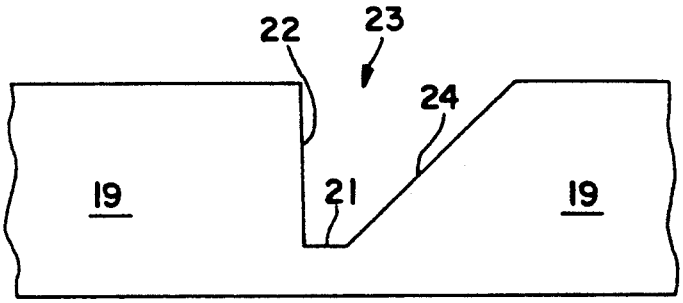
FIG. 2 is an enlarged fragmentary bottom elevational view of a portion of the continuously connected ladder stock shown in FIG. 1.

Referring now to FIG. 1, there is shown a portion of one type of continuously connected ladder stock 11 with which the apparatus of the present invention is particularly well-suited for use (it being understood that the apparatus of the present invention may be used with other types of continuously connected ladder stock). As can be seen, ladder stock 11 comprises a plurality of interconnected, individual fasteners 13 formed from a pair of elongated side members 15-1 and 15-2 coupled together by a plurality of cross links or filaments 17. Side member 15-1 is shaped to define a plurality of T-bars 19. Referring now to FIG. 2, T-bars 19 can be seen to be interconnected by severable connectors 21. The rear portion of each T-bar 19 is shaped to include a generally perpendicular or slightly angled surface 22, and the front portion of each T-bar 19 is shaped to include a more obliquely angled surface 24. Surface 22, connector 21 and surface 24 collectively define a saw-tooth-like indentation or notch 23.

Referring back to FIG. 1, side member 15-2 is shaped to define a plurality of paddles 25 which are interconnected by easily separable connectors 27. Typically, once the T-bar 19 of a fastener 13 has been ejected from the apparatus and inserted into a desired article of commerce, the connector 27 connecting the paddle 25 of the inserted fastener to the remainder of side member 15-2 is disconnected therefrom by pulling the apparatus and the remainder of side member 15-2 away from the inserted fastener until the connector 27 breaks.

Figure 3A:
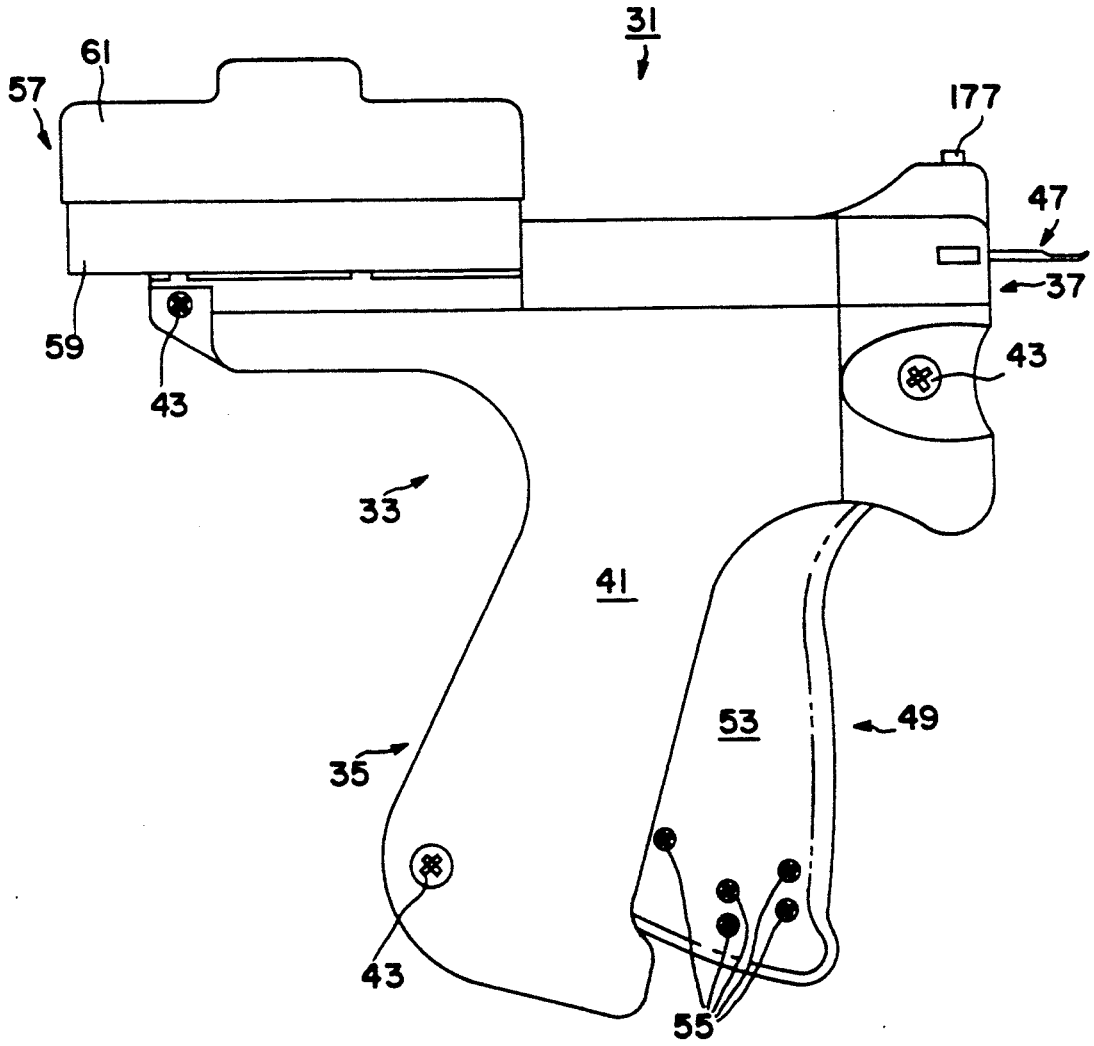
FIG. 3(*a*) is a left side elevational view of one embodiment of an apparatus for dispensing individual plastic fasteners from continuously connected ladder stock, the apparatus being constructed according to the teachings of the present invention.
Figure 3B:
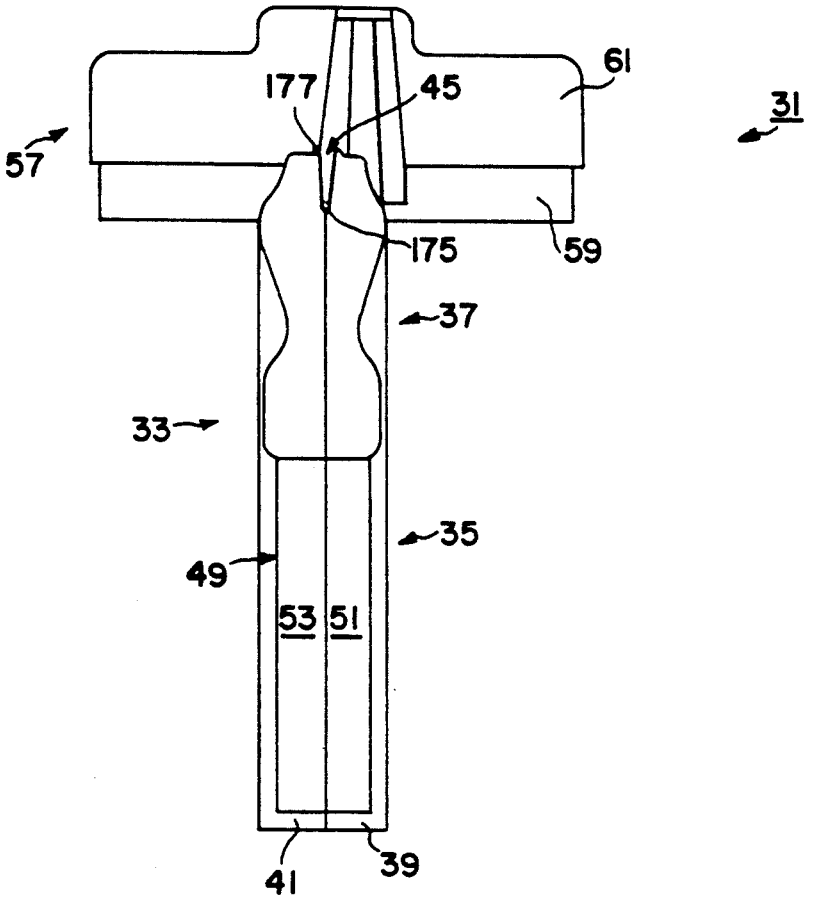

Referring now to FIGS. 3(*a*) and 3(*b*), there is shown one embodiment of an apparatus for dispensing an individual plastic fastener from continuously connected ladder stock, the apparatus being constructed according to the teachings of the present invention and represented generally by reference numeral 31.

Apparatus 31 includes a hollow gun-shaped casing 33 defining a handle portion 35 and a barrel portion 37, casing 33 being formed from two halves, a right half 39 and a left half 41. Right half 39 and left half 41, which may be fabricated from any convenient material, such as molded plastic, are joined together using screws 43 (or, alternatively, may be joined together by a snap-fit, by sonic welding, by gluing, by riveting, or the like). As will be discussed below in greater detail, the front end of barrel portion 37 is shaped to define an opening 45, into which is removably mounted a hollow slotted needle 47 to be described below in greater detail.

Apparatus 31 also includes a trigger 49, which is pivotally mounted in casing 33. Trigger 49 is formed from two halves, a right half 51 and a left half 53. Right half 51 and left half 53, which may be fabricated from any convenient material, such as molded plastic, are joined together using screws 55.

Apparatus 31 further includes ladder stock supply means 57, from which ladder stock is fed to the feed track of the apparatus and in which unused ladder stock is stored. In the embodiment shown, ladder stock supply means 57 includes a base 59 mounted on the top of casing 33 and a cover 61 removably mounted on base 59.

Figure 4:
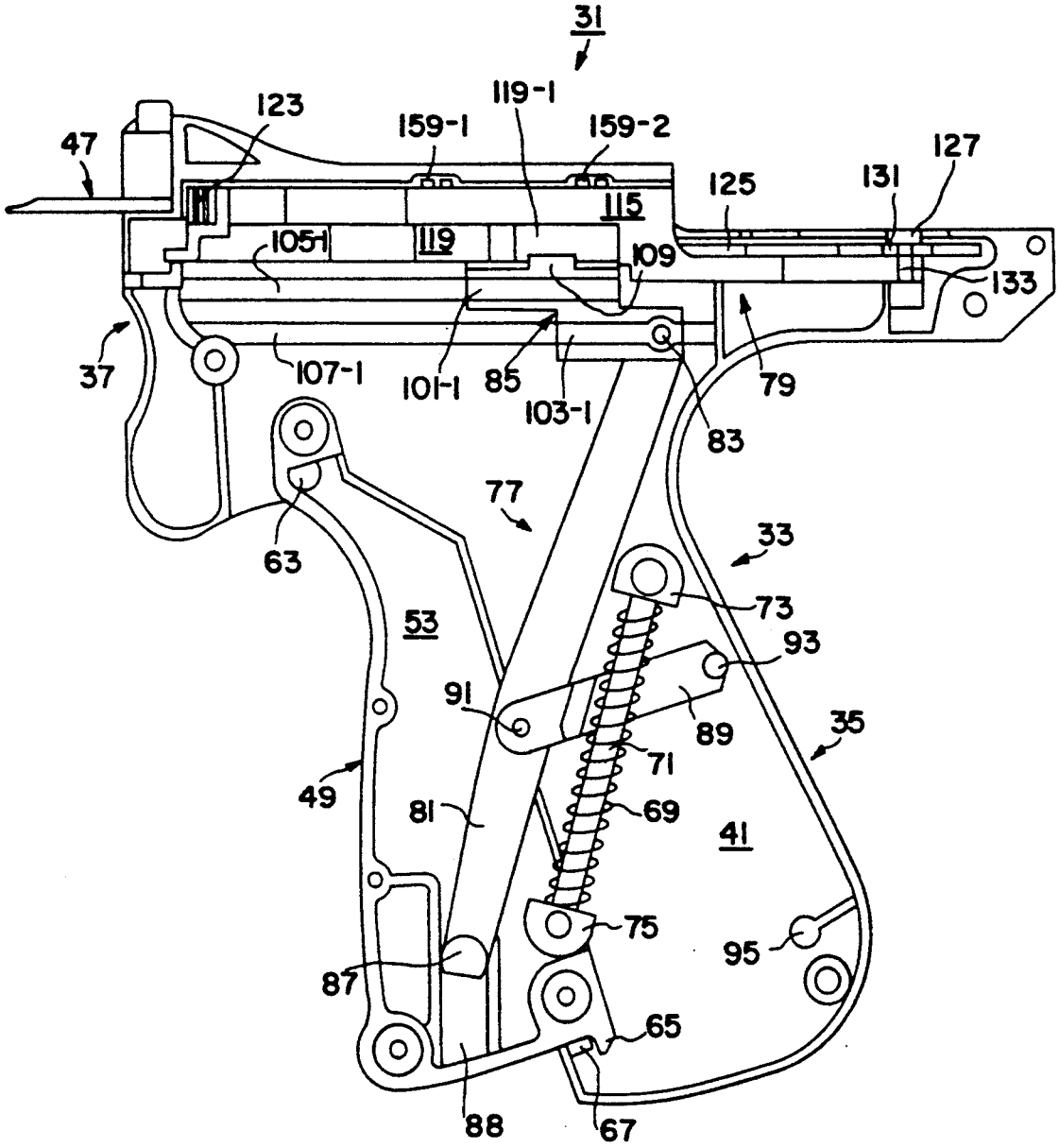
FIG. 4 is a right side elevational view of the apparatus shown in FIG. 3(*a*) with the right half of the gun-shaped casing, the right half of the trigger, and the ladder stock supply means removed, the triggering mechanism being shown in its rest position.

Referring now to FIG. 4, apparatus 31 is shown without right half 39 of casing 33, right half 51 of trigger 49, and supply means 57 in order to more clearly disclose the internal components of apparatus 31. As can be seen, the internal components of apparatus 31 include a triggering mechanism. The triggering mechanism includes a pivot pin 63 for pivotally mounting trigger 49 within casing 33. Pivotal motion of trigger 49 in the direction away from handle portion 35 of casing 33 is restricted by the engagement of a stop tab 65 formed on trigger 49 with a bumper 67 formed on handle portion 35 of casing 33. Pivotal motion of trigger 49 in the direction towards handle portion 35 of casing 33 is mediated by a compression spring 69 mounted longitudinally along an elongated rod 71. One end of rod 71 is secured to a post 73 disposed in handle portion 35, and the other end of rod 71 is secured to a post 75 seated within trigger 49.

Figure 5:
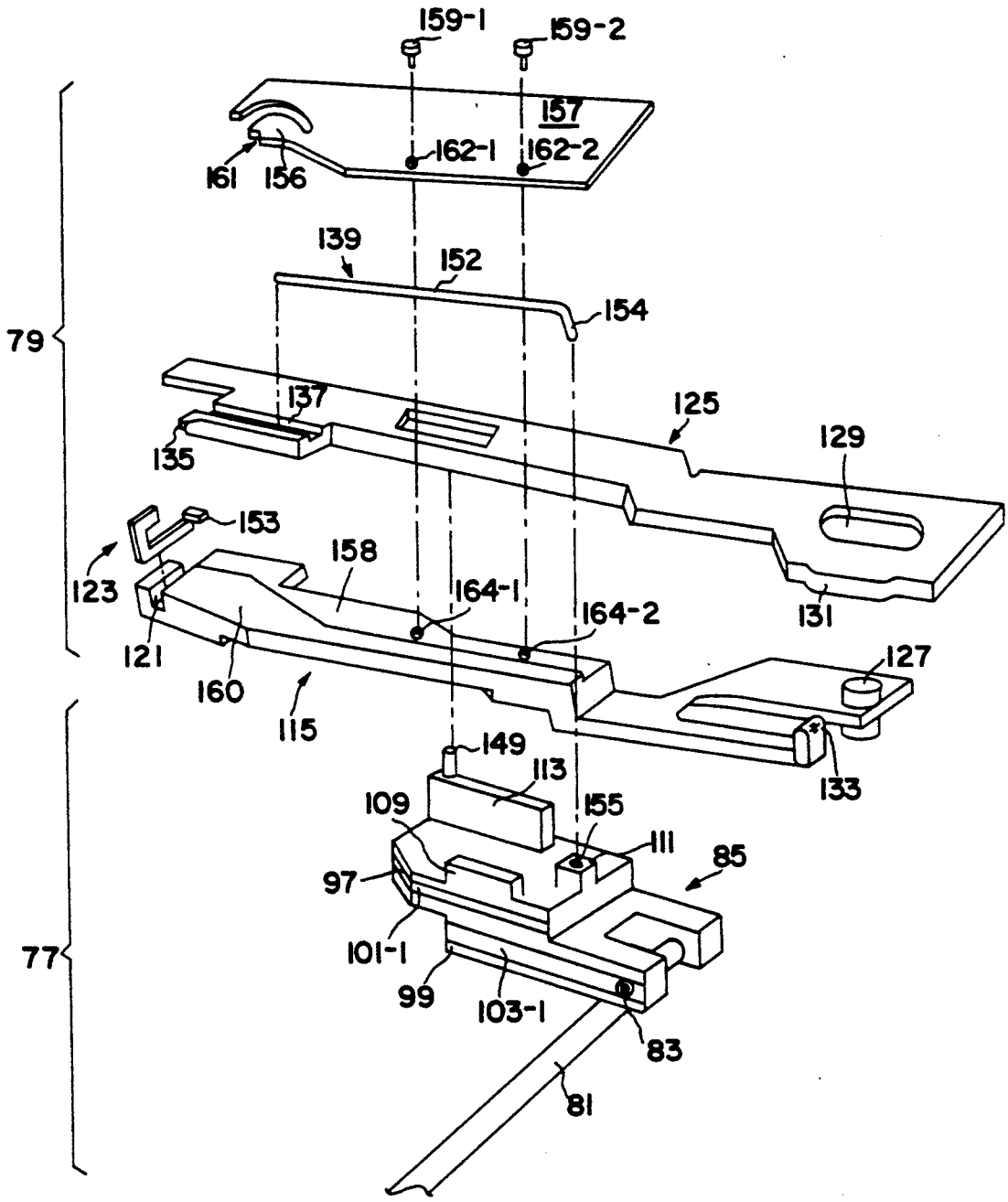
FIG. 5 is a fragmentary, exploded view of the slider assembly and the feeding/severing/ejecting assembly shown in FIG. 4.

In addition to the above-described triggering mechanism, the internal components of apparatus 31 also include a slider assembly 77 (a portion of which is also shown in FIG. 5.) As will be described below, slider assembly 77 serves to mechanically couple the triggering mechanism to a feeding/severing/ejecting assembly 79 disposed longitudinally along barrel portion 37 of casing 33.

Slider assembly 77 comprises a drive link 81. Drive link 81 is coupled at one end by a pivot pin 83 to a slider 85. A boss 87 is formed at the opposite end of link 81, boss 87 traveling in a slot 88 formed in trigger 49 to transmit trigger motion to slider assembly 77 as trigger 49 is rotated about pivot pin 63. An idler link 89 rotates between link 81 (to which it is pivotally attached by a pivot pin 91) and a pivot 93 to which it is also attached in handle portion 35. This produces decreasing mechanical leverage by trigger 49 to the upper end of drive link 81 while producing accelerated forward movement of slider 85 during compression of trigger 49. The rearward motion of trigger 49 is limited by a bumper 95.

Slider 85 can be seen in FIGS. 4 and 5 to be a step-shaped structure comprising a top section 97 and a bottom section 99. Top section 97 and bottom section 99 are each shaped to define a pair of longitudinally extending grooves 101-1/101-2 and 103-1/103-2, respectively, which extend along the respective right and left sides thereof. (Grooves 101-2 and 103-2, which are formed on the left sides of sections 97 and 99, respectively, are not shown.) Grooves 101-1/101-2 and 103-1/103-2 engage corresponding rails 105-1/105-2 and 107-1/107-2 formed along the inner surfaces of right half 39 and left half 41 of casing 33 (rails 105-2 and 107-2 of right half 39 not being shown) to permit slider 85 to move longitudinally across barrel portion 37 of casing 33.

As can be seen best in FIG. 5, top section 97 of slider 85 is shaped to define a plurality of upwardly-extending projections 109, 111, and 113, the respective functions of which will become apparent from the description to follow. A peg 149 is fixedly mounted in the top surface of projection 113 and extends upwardly therefrom. A hole 155 is formed in projection 111.

Figure 6:
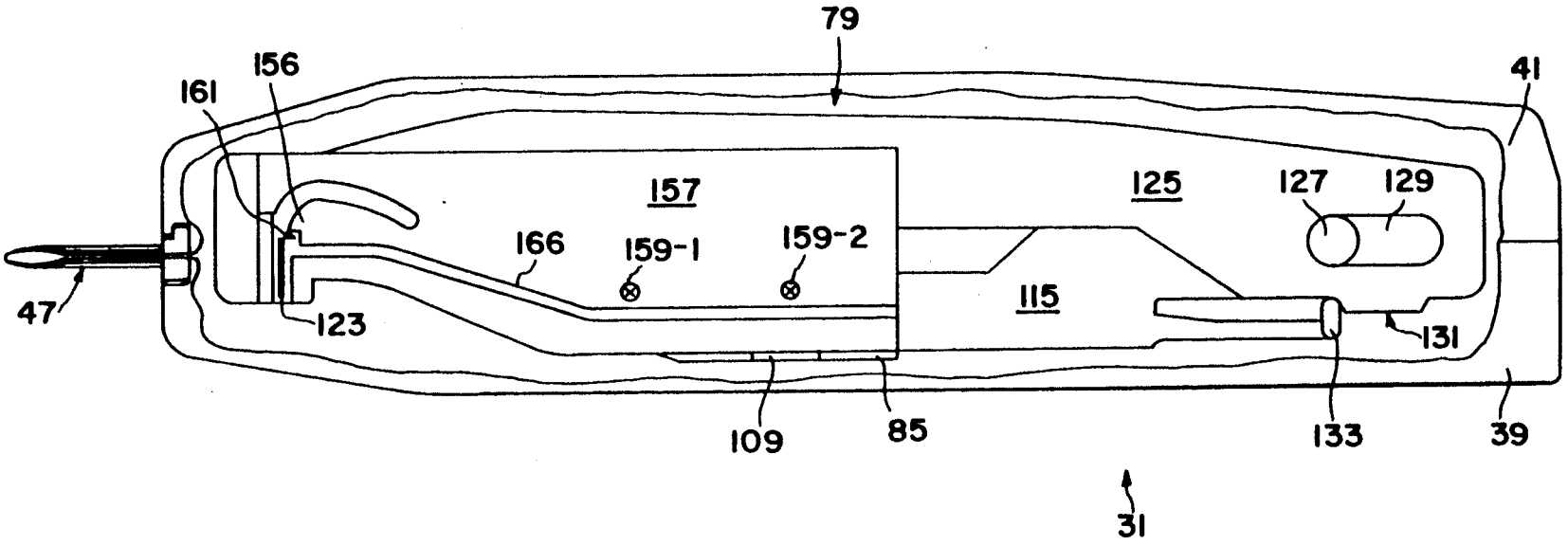
FIG. 6 is a top elevational view of the apparatus shown in FIG. 3(*a*) with the ladder stock storage means removed and the gun-shaped casing broken away in part to reveal the components located therewithin, the slider assembly and the feeding/severing/ejecting assembly being shown as they appear when the triggering mechanism is in its rest position.

Referring back to FIG. 4, the internal components of apparatus 31 can also be seen to include feeding-/severing/ejecting assembly 79 (see also FIGS. 5 and 6).

Assembly 79 includes an elongated carriage 115, which is pivotally mounted within barrel portion 37 of casing 33. (Carriage 115 is shown separately in FIGS. 7(*a*) through 7(*c*)). As seen best in FIGS. 7(*b*) and 7(*c*), the lower portion of the right side of carriage 115 is shaped to define a stepped surface 119 having a working or contacting facet 119-1. As will be seen below, working facet 119-1 is adapted to be engaged by projection 109 of slider 85 during the initial stages of a trigger stoke, thereby effectively controlling the extent, if any, of pivotal movement of carriage 115 during the initial stages of a trigger stroke.

Figure 7A:
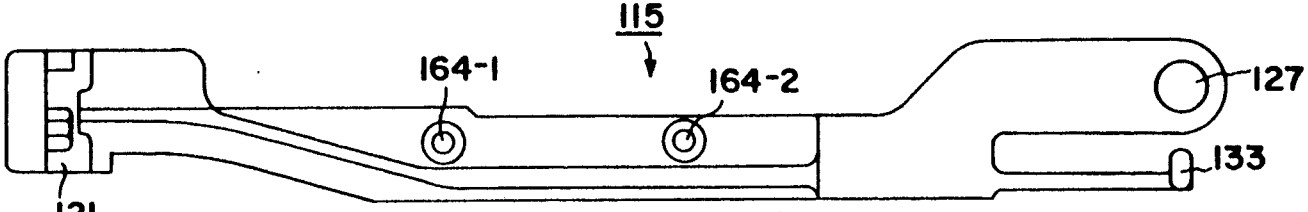
FIGS. 7(*a*) and 7(*b*) are top and right side elevational views, respectively, of the carriage shown in FIG. 4.
Figure 7B:
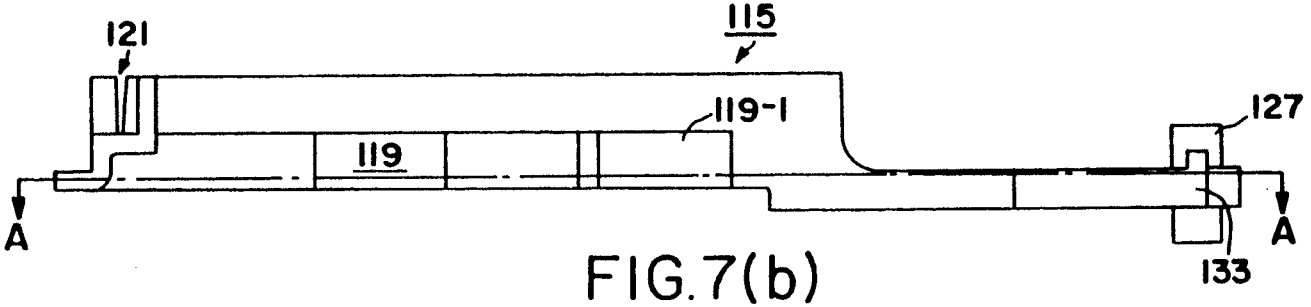
Figure 7C:
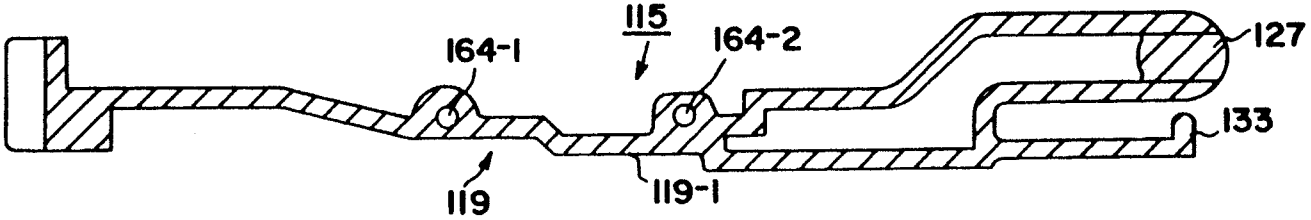

As seen best in FIGS. 5 and 7(*b*), a laterally extending slot 121 is formed near the front end of carriage 115. Slot 121 receives in sliding engagement therewith means for regulating forward movement of the forwardmost fastener in the chain of ladder stock, the regulating means of the present invention being embodied in the form of a clip-like gate referred to hereafter as an anti-forward 123.

Referring back to FIGS. 4 through 6, assembly 79 can also be seen to include a feeder 125. (Feeder 125 is shown separately in FIGS. 8(*a*) through 8(*c*).) Feeder 125, which is slidably mounted on carriage 115 for reasons to be discussed below, is positioned longitudinally relative to carriage 115 by means of an oval-shaped slot 129, which is adapted to receive an upwardly-extending post 127 formed on carriage 115. Feeder 125 is positioned laterally relative to carriage 115 by means of a bump 131, which contacts an upwardly extending post 133 formed on carriage 115.

Figure 8A:
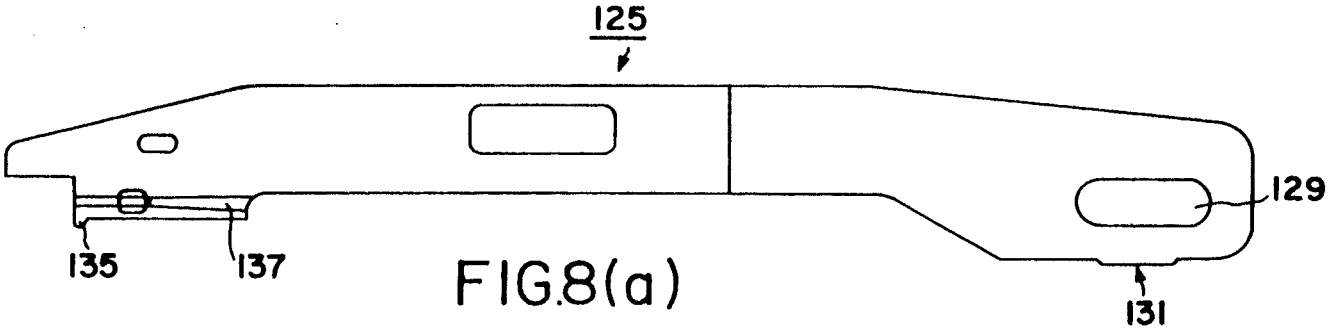
FIGS. 8(*a*) through 8(*c*) are top, right side, and bottom elevational views, respectively, of the feeder shown in FIG. 4.
Figure 8B:
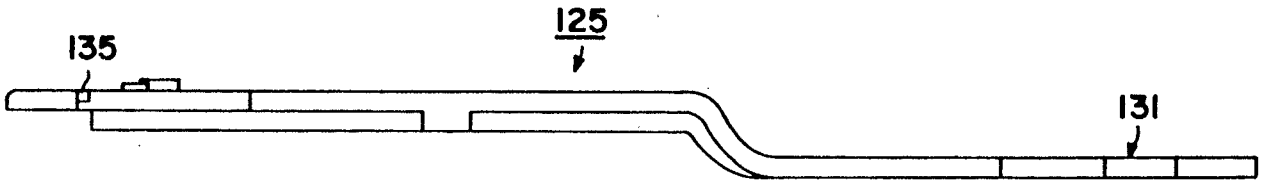
Figure 8C:
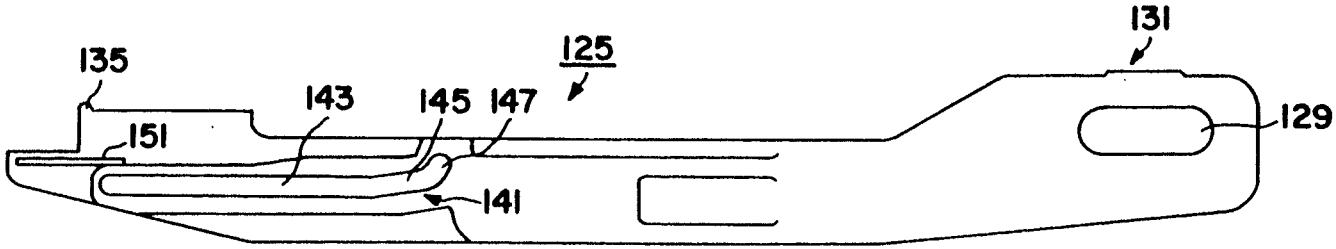

As seen best in FIGS. 5 and 8(*a*), feeder 125 includes a laterally-extending pawl 135, which is adapted to engage the notch between successive fasteners in a length of ladder stock. In the embodiment shown, pawl 135 has a shape that closely conforms to the shape of notch 21. In this manner, pawl 135 fits notch 21 directionally to provide a ratchet-type feeding mechanism, i.e., pawl 135 cannot move forward relative to notch 21 because of perpendicular surface 22 but it can slide rearwardly out of notch 21 because of the slant in surface 24 to engage the next notch 21 in the fastener chain.

Feeder 125 also includes along its top surface a longitudinally extending groove 137. As will be discussed below, groove 137 is adapted to receive in sliding engagement therewith an ejector rod 139.

As seen best in FIG. 8(*c*), the bottom surface of feeder 125 includes an elongated groove 141. Groove 141 can be thought of as being made up of the following three portions: (1) a first portion 143, which extends longitudinally rearwardly from the front end of feeder 125; (2) a second portion 145, which is adjacent to first portion 143 and which extends both rearwardly and slightly laterally therefrom; and (3) a third portion 147, which is adjacent to second portion 145 and which extends both rearwardly and more sharply laterally therefrom. As will be seen below, groove 141 is engaged by peg 149 of slider 85 (see FIG. 5), which, depending on its location within groove 141, drives feeder 125 either longitudinally or both laterally and longitudinally.

The bottom surface of feeder 125 also includes a longitudinally-extending slot 151. Slot 151 is used to retain the longitudinally extending member 153 of anti-forward 123 (see FIG. 5) so that, when feeder 125 is moved laterally, anti-forward 123 is driven laterally by feeder 125.

Referring back now to FIG. 5, assembly 79 can also be seen to include an ejector rod 139. Ejector rod 139, which is used to eject separated fasteners from needle 47 (see FIG. 4) in the manner to be discussed below, is an L-shaped member including a long arm 152 and a short arm 154. Long arm 152 is slidably mounted within groove 137 of feeder 125, and short arm 154 is pivotally mounted in hole 155 of slider 85.

Figure 9:
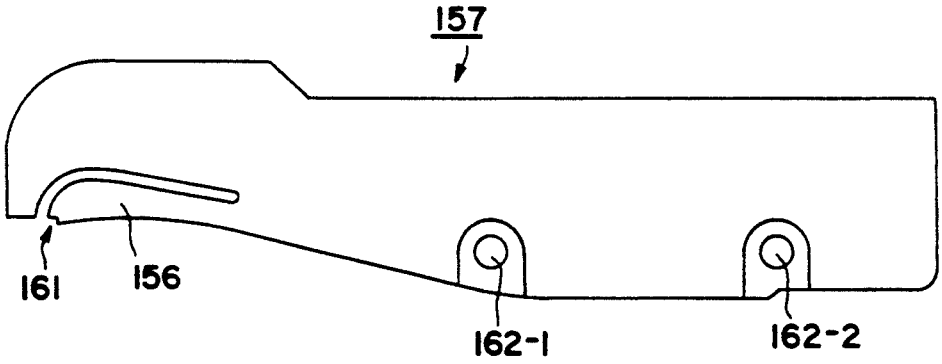
FIG. 9 is a top elevational view of the cover shown in FIG. 5.

Assembly 79 further includes a cover plate 157 (see also FIGS. 6 and 9). Cover plate 157 is fixedly mounted on a surface 158 of carriage 115 with a pair of screws 159-1 and 159-2, which are inserted through holes 162-1/162-2 and 164-1/164-2 formed in plate 157 and surface 158, respectively (it being understood that other means besides screws 159-1 and 159-2 may be used to secure cover plate 157 to surface 158 of carriage 115). The right side of cover plate 157, together with the left edge of surface 160 of carriage 115, forms a feed track 166 (see FIG. 6), through which ladder stock is advanced from supply means 57. The front portion of cover plate 157 is shaped to include a spring-like articulating arm 156, which is compressed by contact with a fastener travelling by it and which springs outwardly once the fastener has passed. The front corner of arm 156 is shaped to define an anti-back 161 which when arm 156 is in its relaxed position, will engage the filament portion of a fastener that is moving rearwardly in the feed track so as to prevent further rearward movement thereof.

Figure 10A:
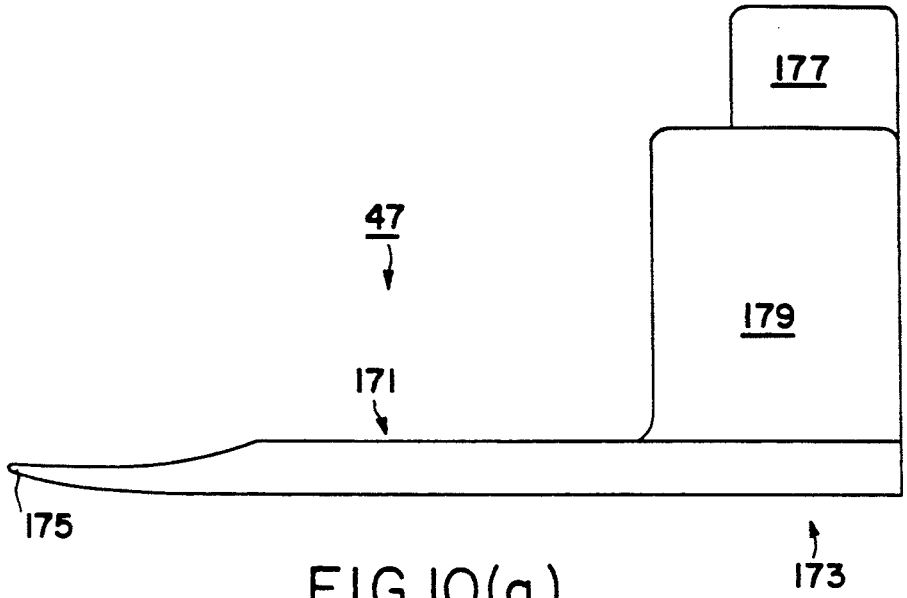
FIGS. 10(*a*) and 10(*b*) are right side and top elevational views, respectively, of the needle shown in FIG. 3(*a*)
Figure 10B:
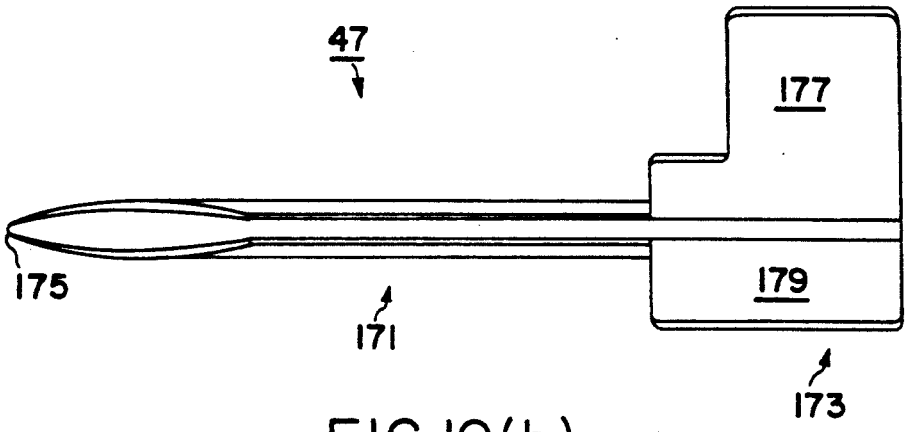
Figure 11A:
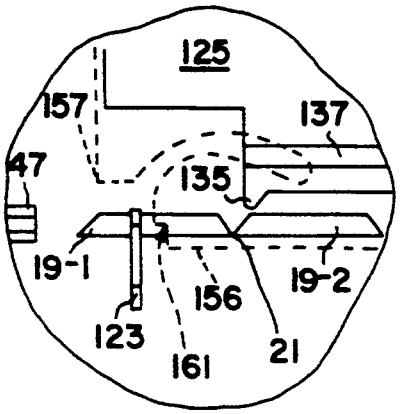
FIGS. 11(*a*) through 11(*d*) are fragmentary schematic views of four key locations within the apparatus of FIG. 3(*a*) as they appear when the triggering mechanism is at rest.
Figure 11B:
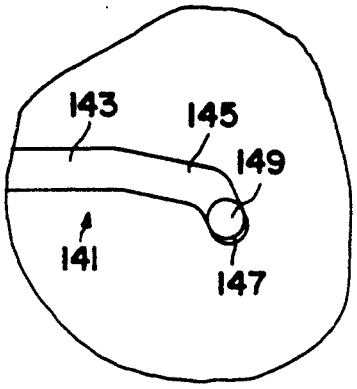
Figure 11C:
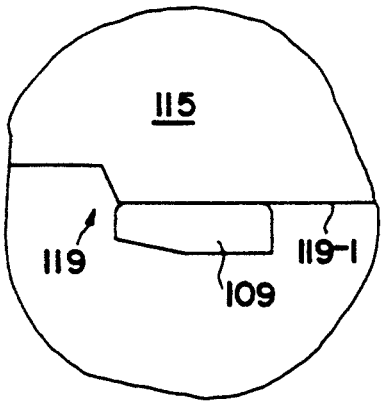
Figure 11D:
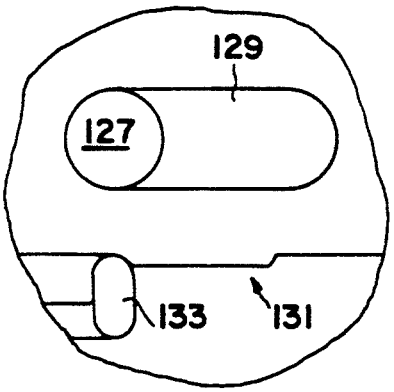
Figure 12A:
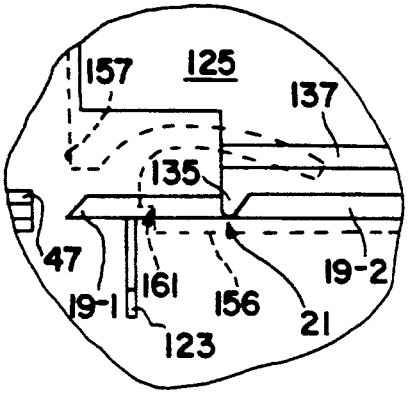
FIGS. 12(*a*) through 12(*d*) are fragmentary schematic views of four key locations within the apparatus of FIG. 3(*a*) as they appear when the triggering mechanism is actuated to the point where the feeder engages the notch between the two forwardmost fasteners of a length of continuously connected ladder stock.
Figure 12B:
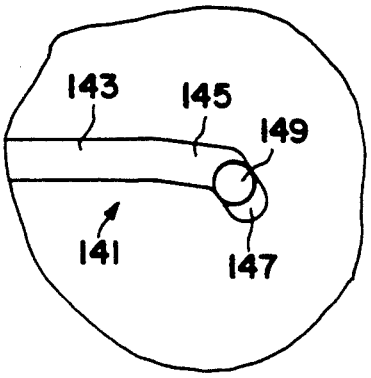
Figure 12C:
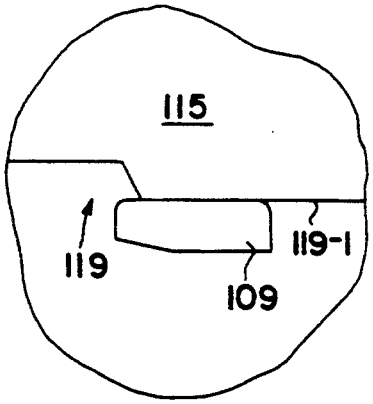
Figure 12D:
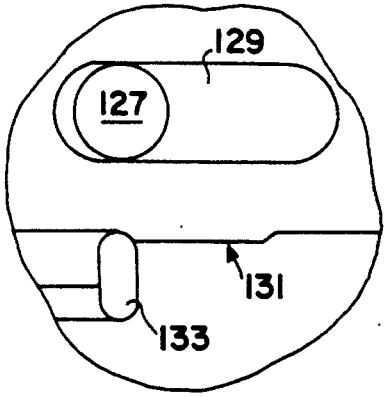
Figure 13A:
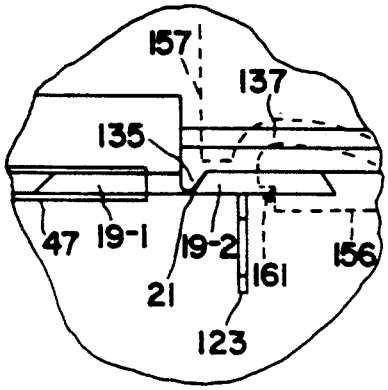
FIGS. 13(*a*) through 13(*d*) are fragmentary schematic views of four key locations within the apparatus of FIG. 3(*a*) as they appear when the triggering mechanism is actuated to the point where the feeder inserts the T-bar portion of the forwardmost fastener into the needle.
Figure 13B:
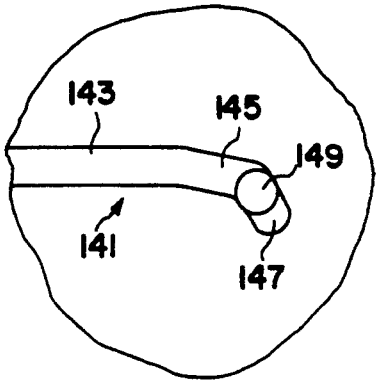
Figure 13C:
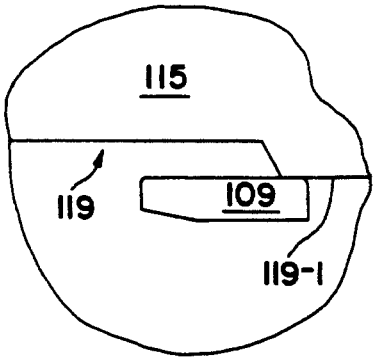
Figure 13D:
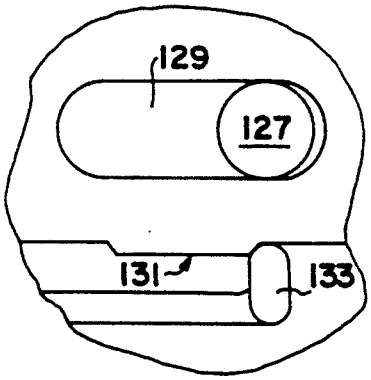
Figure 14A:
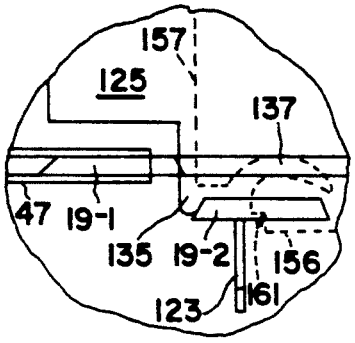
FIGS. 14(*a*) through 14(*d*) are fragmentary schematic views of four key locations within the apparatus of FIG. 3(*a*) as they appear when the triggering mechanism is actuated to the point where the feeder and the carriage pivot in such a way as to cause the remainder of the length of continuously connected ladder stock to be severed from the T-bar portion of the forwardmost fastener.
Figure 14B:
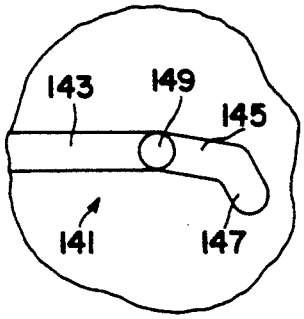
Figure 14C:
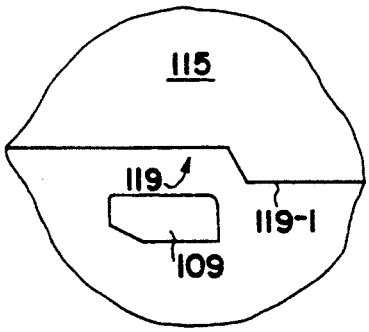
Figure 14D:
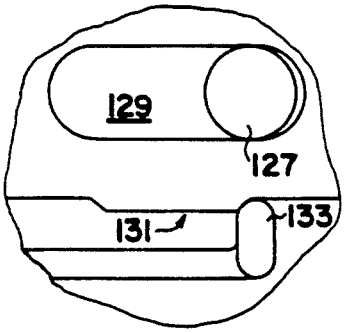
Figure 15A:
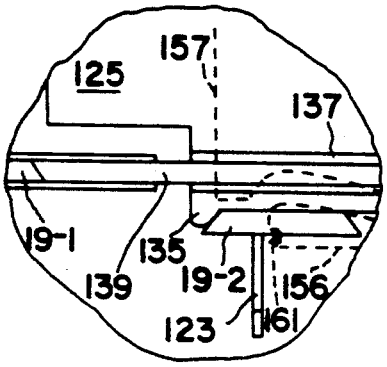
FIGS. 15(*a*) through 15(*d*) are fragmentary schematic views of four key locations within the apparatus of FIG. 3(*a*) as they appear when the triggering mechanism is actuated to the point where the ejector rod ejects the T-bar portion of the forwardmost fastener from the needle.
Figure 15B:
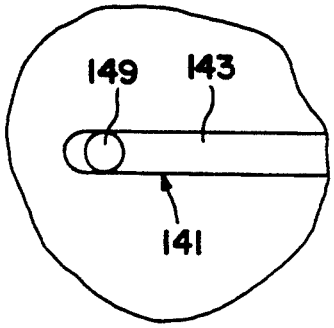
Figure 15C:
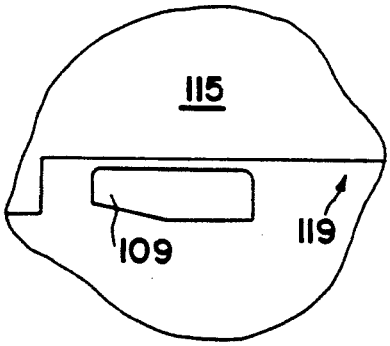
Figure 15D:
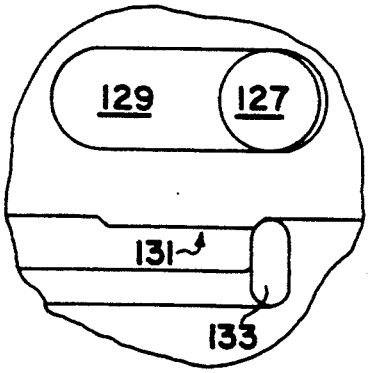

Referring now to FIGS. 10(*a*) and 10(*b*), needle 47 is shown in greater detail. Needle 47, which is preferably made from a single sheet of metal by a stamping or roll-forming technique, comprises an elongated, generally cylindrical, hollow, slotted member having a chunk portion 171 and a base portion 173. Shank portion 173 terminates at its front end in a relatively sharp tip 175. Base portion 173, which is sized and shaped for insertion into opening 45 of casing 33, includes a pair of upwardly extending tabs 177 and 179. Tab 177 is a spring tab which presses outwardly against the inner surface of opening 45 to releasably secure base portion 173 therewithin. Tab 179 provides the user with a portion of the needle that may be grasped with one hand to assist in pulling the needle out of the opening when so desired.

Referring now to FIGS. 11 through 15, the operation of apparatus 31 is depicted with the aid of a series of drawings which illustrate, at five different times during an exemplary trigger stroke, four key locations within apparatus 31. The first key location, shown in FIGS. 11(*a*), 12(*a*), 13(*a*), 14(*a*) and 15(*a*), is the front end of apparatus 31 including needle 47 and the front end of assembly 79. (Cover plate 157 is shown therein using dotted lines so as not to obscure the components disposed therebelow, and carriage 115 is not shown at all for purposes of clarity and simplicity.) The second key location, shown in FIGS. 11(*b*), 12(*b*), 13(*b*), 14(*b*) and 15(*b*), is the area of interaction between groove 141 of feeder 125 and peg 149 of slider 85. The third key location, shown in FIGS. 11(*c*), 12(*c*), 13(*c*), 14(*c*) and 15(*c*), is the area including stepped surface 119 of carriage 115 and projection 109 of slider 85. The fourth key location, shown in FIGS. 11(*d*), 12(*d*), 13(*d*), 14(*d*) and 15(*d*), is the rear end of apparatus 31 including the rear portions of feeder 125 and carriage 115, respectively.

Referring now to FIGS. 11(*a*) through 11(*d*), the four key locations within apparatus 31 are shown as they appear when the triggering mechanism is at rest, i.e., when slider 85 is at its rearwardmost position in barrel portion 37 (see FIG. 4). With slider 85 thus positioned, peg 149 is positioned at the rearwardmost point of third portion 147 of groove 141 (see FIG. 11(*b*)). As seen in FIG. 11(*d*), this causes feeder 125 to be positioned longitudinally and laterally relative to carriage 115 so that the front end of slot 129 is in contact with post 127 and so that the front side of bump 131 is in contact with post 133. As seen in FIG. 11(*a*), this also causes pawl 135 of feeder 125 to be positioned just to the rear and off to the side of notch 21 between adjacent T-bars 19-1 and 19-2. Moreover, because the longitudinally-extending portion 153 (see FIG. 5) of anti-forward 123 is seated within slot 151 (see FIG. 8(*c*)) of feeder 125, the lateral positioning of feeder 125 causes anti-forward 123 to be positioned so as to engage the filament portion (not shown) to which T-bar 19-1 is connected should any undesired forward advancement of the fastener chain be induced. As can also be seen in FIG. 11(*a*), because of the relative positions of fastener 19-1 and articulating arm 156, anti-back 161 of cover plate 157 is also positioned so as to engage the filament portion (not shown) to which T-bar 19-1 is connected should any undesired rearward movement of the fastener chain be induced. Finally, as seen in FIG. 11(*c*), because slider 85 is at its rearwardmost position in barrel portion 87, projection 109 is aligned with contacting facet 119-1 of carriage 115. As will be seen below, this alignment of projection 109 with contacting facet 119-1 prevents carriage 115 from pivoting prematurely.

Referring now to FIGS. 12(*a*) through 12(*d*), the effects of initial actuation of the triggering mechanism of apparatus 31 (and, therefore, of initial movement slider 85 across barrel portion 37) can be seen. As seen in FIG. 12(*b*), initiating actuation of the triggering mechanism causes peg 149 to move longitudinally to a forward position within third portion 147 of groove 141, thereby inducing the simultaneous forward and pivotal movement of feeder 125 relative to carriage 115. This forward and pivotal movement of feeder 125 is seen in FIG. 12(*d*) by the movement of slot 129 relative to post 127 and the movement of bump 131 relative to post 133. In addition, this forward and pivotal movement of feeder 125 is seen in FIG. 12(*a*) by the engagement of pawl 135 with notch 21 and the movement of anti-forward 123 out of alignment with the filament attached to T-bar 19-1. As seen in FIG. 12(*c*), actuation of the triggering mechanism also causes projection 109 to begin to be pushed across a part of facet 119-1. Nevertheless, at its present position, projection 109 is still aligned with facet 119-1 in such a way as to prevent pivotal movement of carriage 115.

Referring now to FIGS. 13(*a*) through 13(*d*), the effects of continued actuation of the triggering mechanism of apparatus 31 (and, therefore, of continued movement of slider 85 across barrel portion 37) can be seen. As seen in FIG. 13(*c*), one such effect is that projection 109 of slider 85 continues to be pushed across facet 119-1 of carriage 115. Another such effect is that peg 149 of slider 85 is caused to engage the front surface of third portion 147 (see FIG. 13(*b*)) and to push feeder 125 longitudinally forward relative to carriage 115 (see FIG. 13(*d*)). This forward longitudinal movement of feeder 125 causes pawl 135 to advance T-bar 19-1 into needle 47 (see FIG. 13(*a*)). As T-bar 19-1 is advanced, it deflects arm 156 of cover plate 157 and the springs back into place to obstruct the rearward movement of T-bar 19-2. The forward longitudinal movement of feeder 125 is stopped when the front end of feeder 125 contacts the front portion of casing 33 (see FIG. 4).

Referring now to FIGS. 14(*a*) through 14(*d*), the effects of further actuation of the triggering mechanism of apparatus 31 (and, therefore, of further movement of slider 85 across barrel portion 37) can be seen. As seen in FIG. 14(*b*), one such effect is that peg 149 is caused to be moved from the forwardmost position in third portion 147 of groove 141 to the forwardmost position in second portion 145 of groove 141. This movement of peg 149, in turn, pushes feeder 125 laterally against carriage 115 until both feeder 125 and carriage 115 pivot together about the carriage pivot point . Because projection 109 is now positioned beyond contacting facet 119-1 of surface 119 (see FIG. 14(*c*)) , carriage 115 is no longer restrained from pivoting by projection 109. As can be seen in FIG. 14(*a*), the pivotal movement of carriage 115 and feeder 125 continues until the connection between T-bars 19-1 and 19-2 is severed and slot 137 of feeder 125 becomes aligned with needle 47. The rear ends of feeder 125 and carriage 115 remain unchanged during this step (see FIG. 14(*d*)).

Referring now to FIGS. 15(*a*) through 15(*d*), the effects of still further actuation of the triggering mechanism of apparatus 31 (and, therefore, of still further movement of slider 85 across barrel portion 37) can be seen. One such effect is that ejector rod 139 is inserted into needle 47 (see FIG. 15(*a*)), causing T-bar 19-1 to be discharged therefrom. To accommodate the range of longitudinal movement required to fully extend ejector rod 139, peg 149 is pushed forwardly from second portion 145 of groove 141 to the forwardmost position in first portion 143 of groove 141 (see FIG. 15(*b*)), and projection 109 continues to be pushed forwardly along, but not in contact with, carriage 115 (see FIG. 15(*c*)) . The rear ends of feeder 125 and carriage 115 remain unchanged during this step (see FIG. 15(*d*)).

Release of trigger 49 causes slider 85 to travel in the reverse direction, causing the components of apparatus 31 to return to the positions seen in FIGS. 11(*a*) through 11(*d*).

As can readily be appreciated, one difference between existing tagger guns and the apparatus of the present invention is that, whereas existing tagger guns typically use a knife or other cutting element to cut the connector between adjacent fasteners, the apparatus of the present invention severs the severable connector by pivoting the obliquely angled surface 24 of a second T-bar away from the generally perpendicular surface 22 of a first T-bar until the severable connector breaks. One advantage to the present technique is that it does not stretch or deform the ends of the fastener during separation as is typically the case with cutting techniques.

The embodiments of the present invention described above are intended to be merely exemplary and those skilled in the art shall be able to make numerous variations and modifications to it without departing from the spirit of the present invention. All such variations and modifications are intended to be within the scope of the present invention as defined by the appended claims.

What is claimed is:

1. An apparatus for dispensing an individual plastic fastener from continuously connected ladder stock including an elongated side member, said elongated side member having a first T-bar at one end thereof, said first T-bar being interconnected to a second T-bar by a severable connector, the apparatus comprising:

a) a hollow casing, said hollow casing having a front end;

b) a hollow, slotted needle mounted on said front end of said hollow casing;

c) a triggering mechanism;

d) means coupled to said triggering mechanism for advancing the continuously connected ladder stock so that said first T-bar is fed into said needle;

e) means coupled to said triggering mechanism for severing the severable connector connecting said first T-bar to said second T-bar, said severing means comprising means for pivoting said second T-bar away from said first T-bar until the severable connector breaks; and f) means coupled to said triggered mechanism for ejecting said first T-bar from said hollow, slotted needle.

2. The apparatus as claimed in claim 1 further comprising anti-forward means for preventing the continuously connected ladder stock from advancing when said triggering mechanism is at rest.

3. The apparatus as claimed in claim 1 further comprising anti-back means for preventing the continuously connected ladder stock from traveling in a direction opposite to the direction of advancement.

4. The apparatus as claimed in claim 1 further comprising ladder stock supply means mounted on said hollow casing for holding a supply of ladder stock.

5. The apparatus as claimed in claim 1 wherein said hollow casing has an opening formed in said front end and wherein said hollow slotted needle includes a shank portion and a base portion, said base portion being sized and shaped for insertion into said opening, said base portion having a first tab which is a spring tab for releasably securing said base portion within said opening.

6. An apparatus for dispensing an individual plastic fastener from continuously connected ladder stock, the continuously connected ladder stock including an elongated side member, said elongated side member having at one end thereof a first T-bar and a second T-bar, said first T-bar having a rear portion and said second T-bar having a front portion, said rear portion of said first T-bar and said front portion of said second T-bar being interconnected by a severable connector, said severable connector, said rear portion of said first T-bar and said front portion of said second T-bar collectively forming a notch, the apparatus comprising:

a) a hollow casing having a front end, said hollow casing comprising an elongated barrel portion and a handle portion;

b) a hollow, slotted needle mounted on said front end of said elongated barrel portion of said hollow casing;

c) a triggering mechanism, said triggering mechanism comprising a trigger mounted on said handle portion of said hollow casing;

d) a carriage disposed within said elongated barrel portion of said hollow casing; said carriage being adapted for pivotal movement;

e) a feeder mounted on said carriage and adapted for both longitudinal and pivotal movement relative thereto, said feeder also being adapted to pivot with said carriage, said feeder having a pawl adapted to engage a notch, said feeder also having an elongated groove, said elongated groove being shaped to define a path to be traveled by said feeder, said path comprising a first portion wherein said feeder is first moved both longitudinally and pivotally so that said pawl engages said notch, a second portion wherein said feeder is moved longitudinally so that said pawl pushes said first T-bar into said hollow, slotted needle, and a third portion wherein said feeder and said carriage are pivoted so as to cause said pawl to pivot said second T-bar away from said first T-bar until the severable connector breaks;

f) an ejector rod adapted for insertion into said hollow, slotted needle; and g) a slider assembly coupled to said triggering mechanism, said slider assembly comprising a slider adapted to travel longitudinally across said elongated barrel portion of said hollow casing, said slider comprising;

i) a peg engageable within said elongated groove of said feeder for driving said feeder along said path, ii) a projection adapted to temporally engage said carriage so as to prevent the pivoting thereof until after the T-bar at one end of the elongated side member has been inserted into said hollow, slotted needle, and iii) means for inserting said ejector rod into said hollow, slotted needle after the severable connector has been broken.

7. The apparatus as claimed in claim 6 further comprising means coupled to said feeder for regulating forward movement of the continuously connected ladder stock.

8. The apparatus as claimed in claim 7 further comprising a cover plate fixedly mounted on said carriage, said cover plate and said carriage jointly defining a feed track.

9. The apparatus as claimed in claim 6 wherein said cover plate includes a spring articulating arm adapted to permit the continuously connected ladder stock to move forwardly but not rearwardly in said feed track.

10. The apparatus as claimed in claim 6 wherein said front end of said barrel portion includes an opening and wherein said hollow, slotted needle includes a shank portion and a base portion, said base portion being sized and shaped for insertion into said opening, said base portion having a first tab for releasably securing stud base portion within said opening, said first tab being a spring tab.

* * * * *

UNITED STATES PATENT AND TRADEMARK OFFICE

CERTIFICATE OF CORRECTION

PATENT NO. : 5,320,269

DATED : June 14, 1994

INVENTOR(S) : Charles L. Deschenes, et al

It is certified that error appears in the above-indentified patent and that said Letters Patent is hereby corrected as shown below:

In Claim 1, Column 11, line 18 of the Patent change "triggered" to --triggering--.

Signed and Sealed this

Twenty-first Day of February, 1995

*Attest:*

*Attesting Officer*

BRUCE LEHMAN

*Commissioner of Patents and Trademarks*